US006115878A

United States Patent [19]

McLaughlin et al.

[11] Patent Number: 6,115,878

[45] Date of Patent: Sep. 12, 2000

[54] APPARATUS FOR REMOVING LIQUID FROM A MOP

[75] Inventors: Hugh Rogers McLaughlin, Aberdour, Bray Road, Foxrock, Dublin 18; John Callaghan, Naas, both of Ireland

[73] Assignee: Hugh Rogers McLaughlin, Ireland

[21] Appl. No.: 09/043,398

[22] PCT Filed: Sep. 20, 1996

[86] PCT No.: PCT/IE96/00063

§ 371 Date: May 11, 1998

§ 102(e) Date: May 11, 1998

[87] PCT Pub. No.: WO97/10742

PCT Pub. Date: Mar. 27, 1997

[30] Foreign Application Priority Data

Sep. 22, 1995 [IE] Ireland ..... S950743

[51] Int. Cl.[7] ..... A47L 13/144

[52] U.S. Cl. ..... 15/262; 15/269

[58] Field of Search ..... 15/119.1, 119.2, 15/260, 262, 264

[56] References Cited

U.S. PATENT DOCUMENTS

| | | | |
|---|---|---|---|
| 1,044,101 | 11/1912 | Steller et al. | 15/262 |
| 2,379,619 | 7/1945 | Baker | 15/262 |
| 2,796,617 | 6/1957 | Bradshaw | 15/262 |
| 4,625,356 | 12/1986 | Meili | 15/260 |
| 4,704,763 | 11/1987 | Sacks et al. | 15/262 |
| 4,720,879 | 1/1988 | Rabban | 15/262 |

*Primary Examiner*—Terrence R. Till

*Attorney, Agent, or Firm*—Michael G. Petit

[57] ABSTRACT

An apparatus is described for removing liquid from a mop (13) of a kind having a mop head in the form of a substantially flat plate (15) having a layer of absorbent sponge-like material (16) on one surface. The apparatus comprises a frame (11) carrying a substantially horizontal roller (22) and a pair of pressure wheels (23). The wheels (23) are spaced from the roller (22) by a distance less than the total thickness of the flat plate (15) and material (16). In use, the mop head is urged downwardly between the roller (22) and pressure wheels (23) substantially in its own plane with the pressure wheels bearing against the surface of the flat plate (15) opposite the sponge-like material (16). The pressure wheels (23) urge the sponge-like material (16) against the roller (22) which expels liquid progressively from the material (16) as the latter moves across it.

20 Claims, 8 Drawing Sheets

APPARATUS FOR REMOVING LIQUID FROM A MOP

FIELD OF THE INVENTION

The invention relates to an apparatus for removing liquid from a mop.

DISCLOSURE OF THE INVENTION

According to the present invention there is provided an apparatus for removing liquid from a mop comprising a frame having a first surface and a second surface spaced from said first surface, such that in use the head of a mop being urged between the surfaces is compressed such that liquid in the mop is expelled.

The preferred embodiment of the invention comprises an apparatus for removing liquid from a mop of a kind having a mop head in the form of a subtantially flat plate having a layer of absorbant sponge-like material on one surface, the apparatus comprising a frame carrying a first, elongated element and at least one second element, the first element being orientated in a direction transverse to the vertical and the second element being spaced from the first element by a distance less than the total thickess of the flat plate and sponge-like material, the mop head being capable of being urged downwardly between the first and second elements with the second element bearing against the surface of the flat plate opposite the sponge-like material, whereby the second element urges the sponge-like material against the first element which expels liquid progressively from the sponge-like material as the latter moves across it.

The invention further provides cleaning equipment comprising the combination of a mop and apparatus as specified in the preceding paragraph.

DESCRIPTION OF THE PREFERRED EMBODIMENTS

Figure 1:
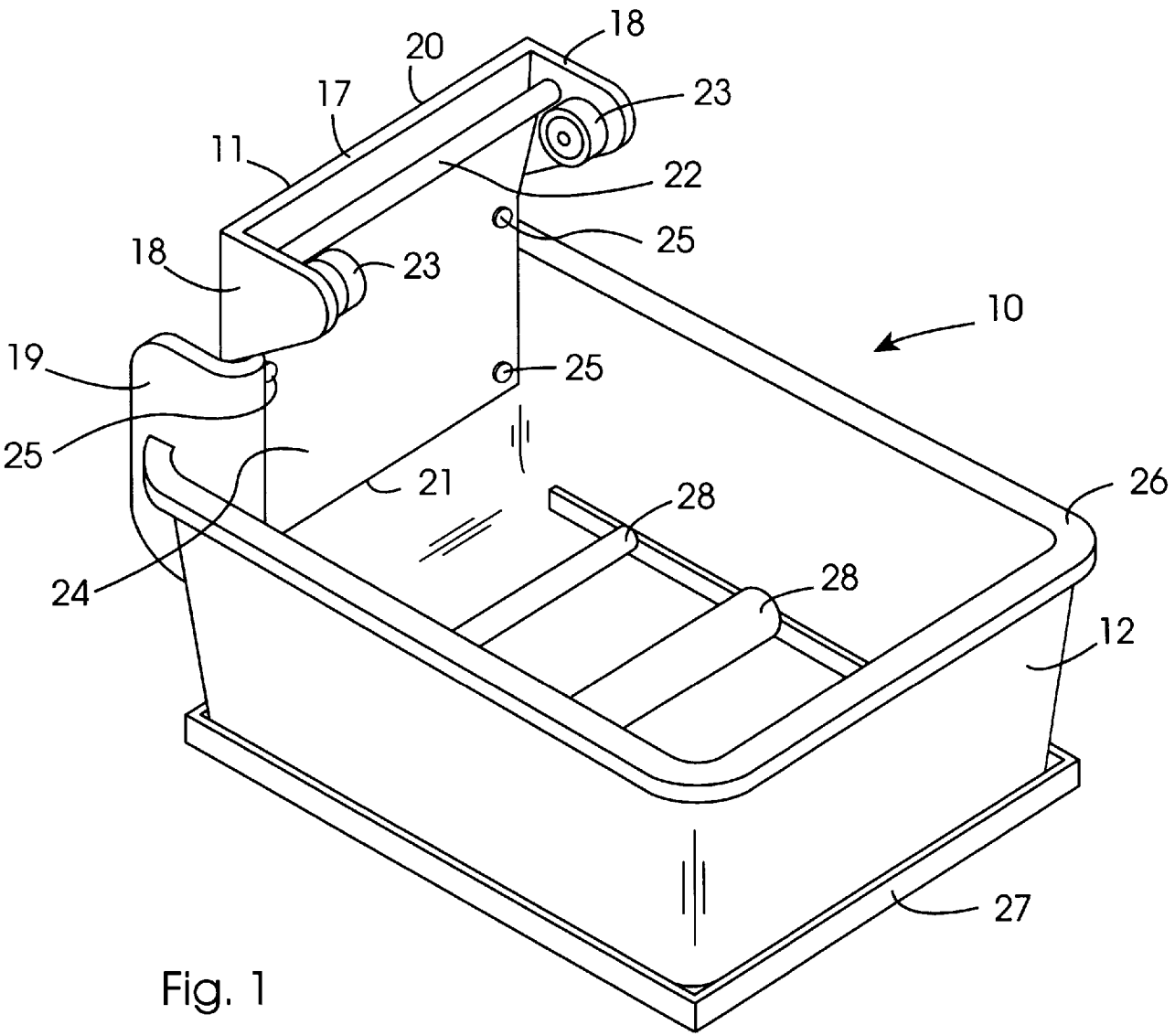
FIG. 1 is a perspective view of an apparatus for removing liquid from a mop according to a first embodiment of the invention.

Embodiments of the invention will now be described, by way of example, with reference to the accompanying drawings. In the figures of the drawings the same reference numerals have been used to indicate the same or equivalent components.

Figure 2:
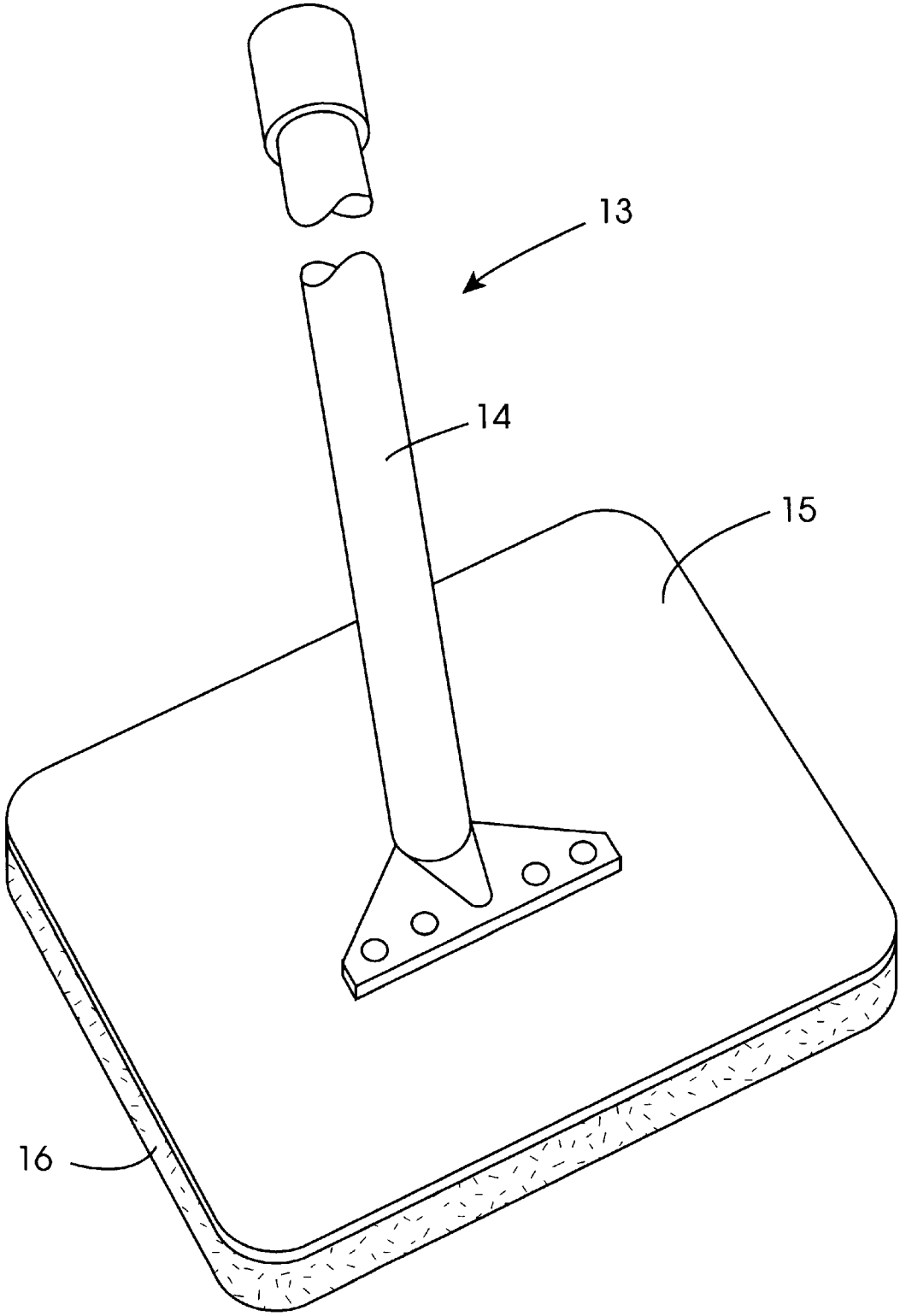
FIG. 2 is a perspective view of a mop for use with the apparatus of FIG. 1.

Referring now to FIGS. 1 to 4 of the drawings, an apparatus 10 for removing liquid from a mop 13, FIG. 2, comprises a frame 11 removably mounted on a bucket 12 for receiving water expelled from the mop.

The mop 13 comprises a mop head in the form of a substantially flat plate 15 of which one surface is covered with a layer of an absorbent sponge or sponge-like material 16. The mop also has a handle 14 which is connected, either fixedly or pivotally, to the surface of the plate 15 opposite the material 16.

The frame 11 comprises a rectangular backplate 17, FIG. 1. Adjacent the top edge 20 of the plate 17 the side edges of the backplate 17 are formed with wings which are bent forwardly to form two parallel flanges 18. Below the flanges 18 the side edges of the plate 17 are formed with further wings which in this case are bent rearwardly to form two parallel clips 19. The clips 19 permit the frame 11 to be removable mounted on a peripheral lip 26 formed around the upper edge of the bucket 12 (see also FIG. 3).

An elongated roller 22 is rotatably mounted substantially horizontally on the frame 11 between the flanges 18, adjacent the backplate 17. Further, a respective pressure wheel 23 is mounted on the inside of each flange 18 in front of the roller 22, the axes of the wheels 23 being substantially parallel to the axis of the roller 22. Each pressure wheel 23 is spaced horizontally from the roller 22 by a distance less than the total thickness of the flat plate 15 and sponge-like material 16.

Figure 3:
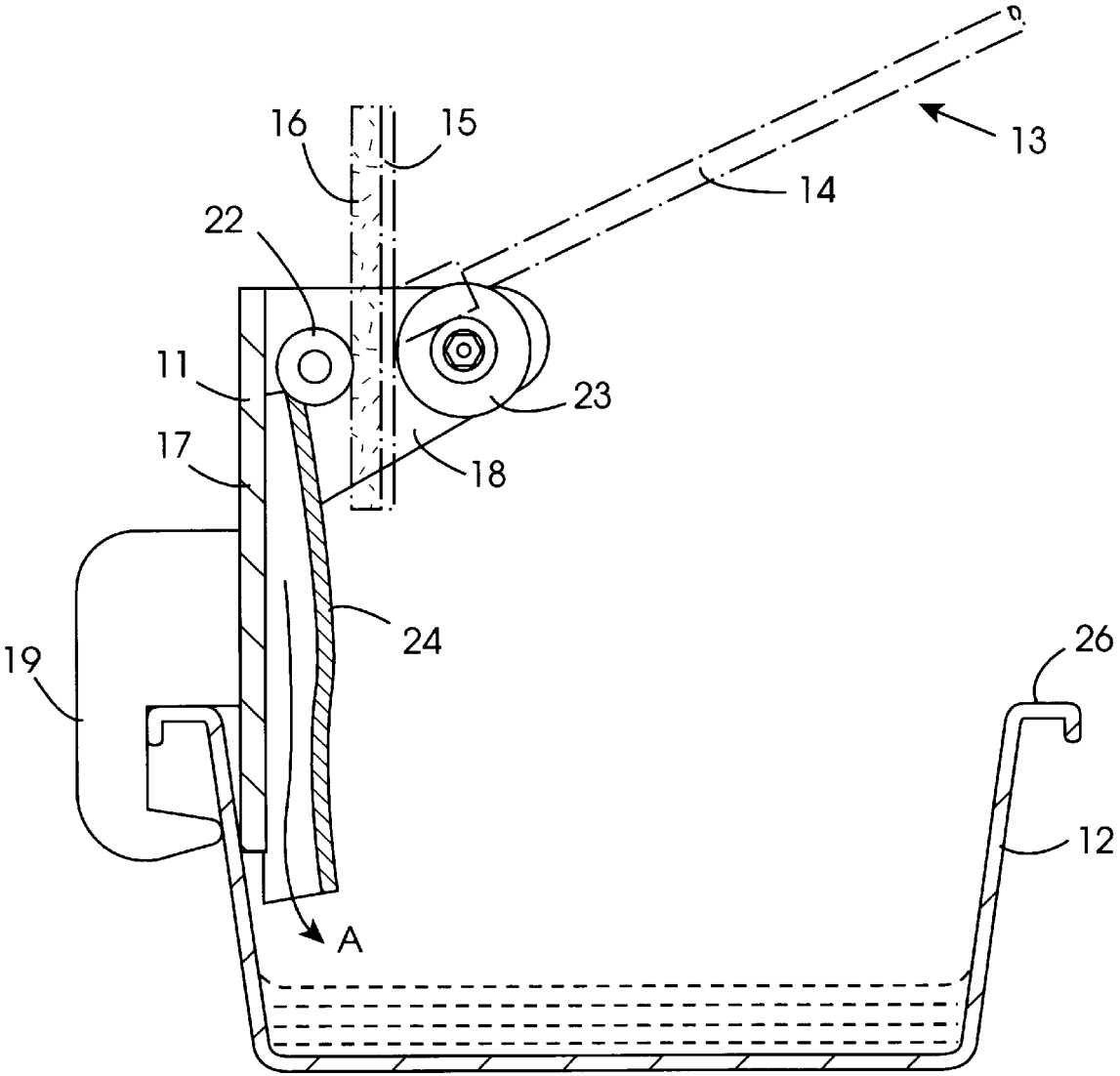
FIG. 3 is a cross-sectional view of the mop of FIG. 2 in use with the apparatus of FIG. 1.
Figure 4:
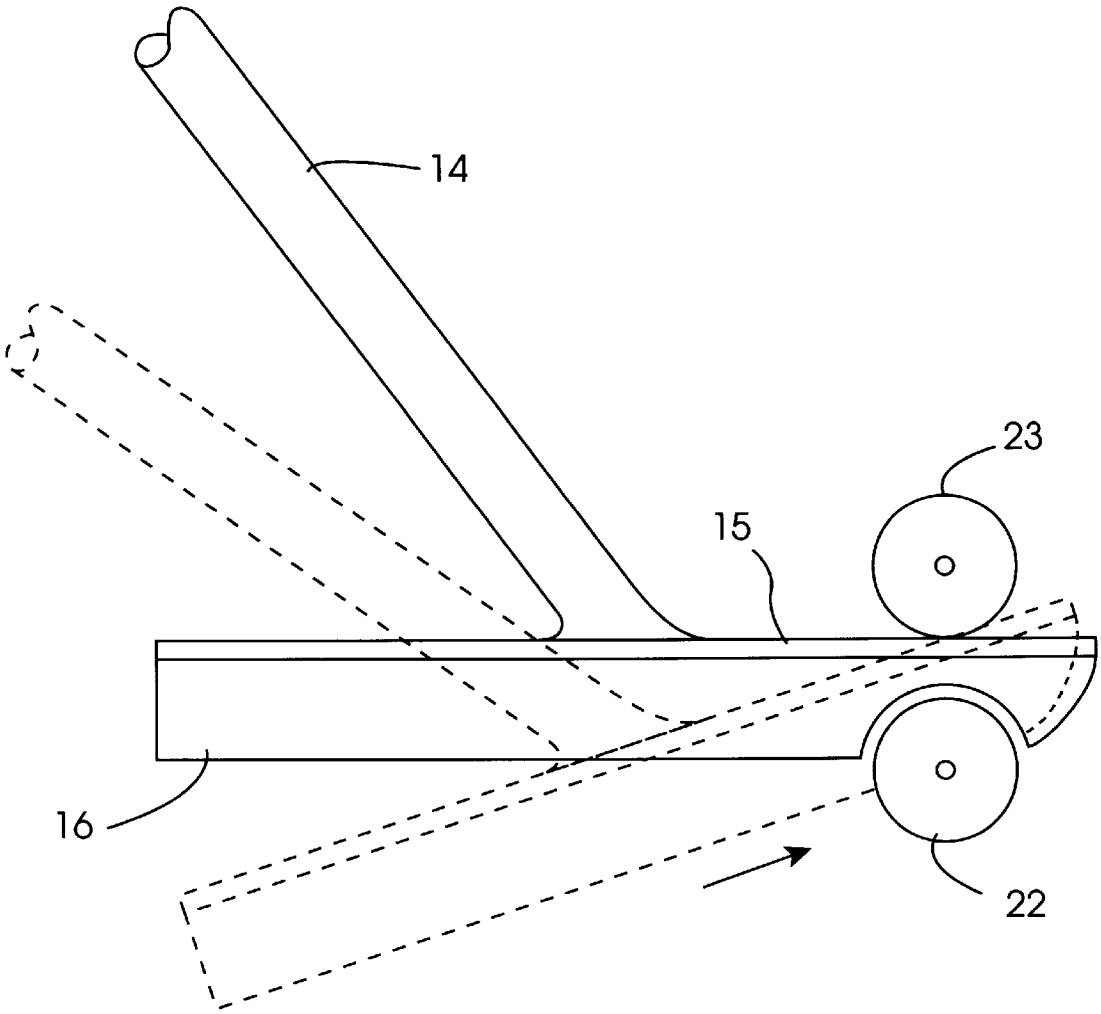
FIG. 4 is a side view of the mop of FIG. 2 in various positions of use with the apparatus of FIG. 1.

In use, FIG. 3, the mop head is urged vertically downwardly substantially in its own plane between the roller 22 and pressure wheels 23, with the pressure wheels 23 each bearing against a respective edge of the surface of the flat plate 15 opposite the sponge-like material 16. Thus the pressure wheels 23 urge the sponge-like material 16 against the roller 22 which expels liquid progressively from the material 16 as the latter moves across the roller 22.

It is preferable, although not necessary, that the roller 22 and/or the wheels 23 are free to rotate. Thus, in variations of the embodiment, either the roller 22 and/or the wheels 23 can be fixed against rotation.

The water expelled from the sponge-like material 16 flows over the top of the roller 22 and down the backplate 17 into the bucket 12. To prevent contact of the sponge-like material 16 with the expelled water a rubber cover 24 is fixed to the backplate 17 with four pins 25, FIG. 1. The upper edge of the rubber cover 24 is in contact with the underside of the roller 22 and the cover 24 is shaped so that the cover is separated sufficiently from the backplate 17 to allow water directed by the cover 24 to flow in the direction of the arrow A into the bucket 12. The rubber cover 24 thus maintains the expelled water separate from the sponge-like material 16.

In the present embodiment, the bucket 12 and frame 11 are fabricated as separate components. It will be realised, however, that the frame 11 and bucket 12 could be fabricated as one piece. Further, the bucket 12 can be seated into a frame 27, FIG. 1, on the underside of which coasters (not shown) are fixed, and this enables the apparatus to be wheeled around a floor.

The bucket 12 can also be provided with a pair of spaced apart parallel rollers 28 located in the floor of the bucket. This allows the user to scrub the sponge-like material 16 over the rollers 28 and displace dirt and grit from the material 16 into the bottom of the bucket. Also, the bucket 12 may house a removable inner bucket (not shown). In such case, water flowing over the roller 22 is guided into the inner bucket which, when full of water, can be removed.

Figure 5:
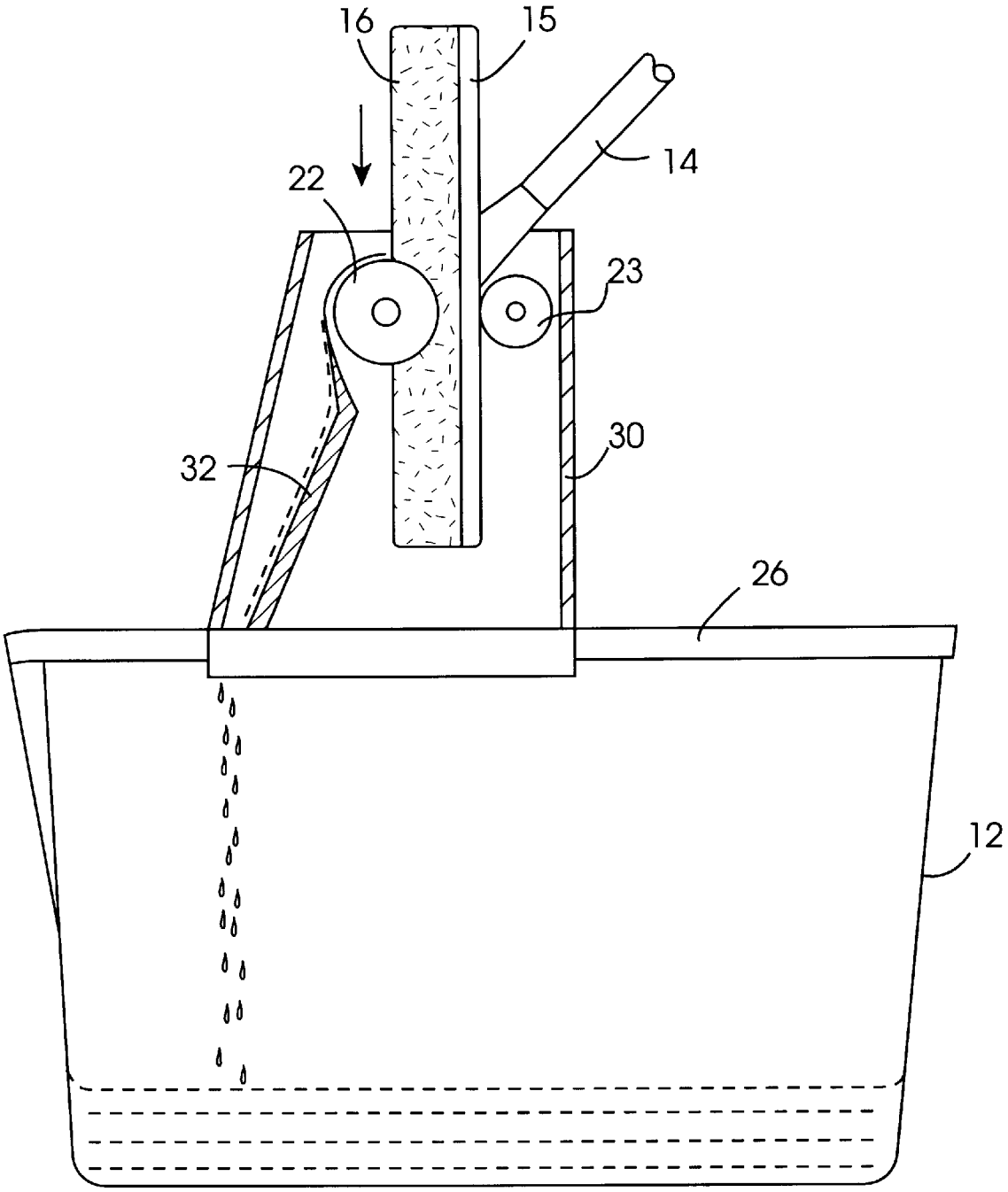
FIG. 5 is a side view of a second embodiment of the invention mounted on a bucket.

A second embodiment of the invention is shown in FIG. 5. In this embodiment a frame 30 carrying roller 22 and pressure wheels 23 removably engages the opposite side edges 26 of the bucket 12 to form a bridge across the open top of the bucket. The orientation and relative positions of the roller 22 and pressure wells 23 are as described for the first embodiment. Water expelled from the sponge-like material 16 passes over the roller 22 and travels down the surface of a sheet member 32 which directs the liquid away from the material 16 and into the bucket 12.

Figure 6:
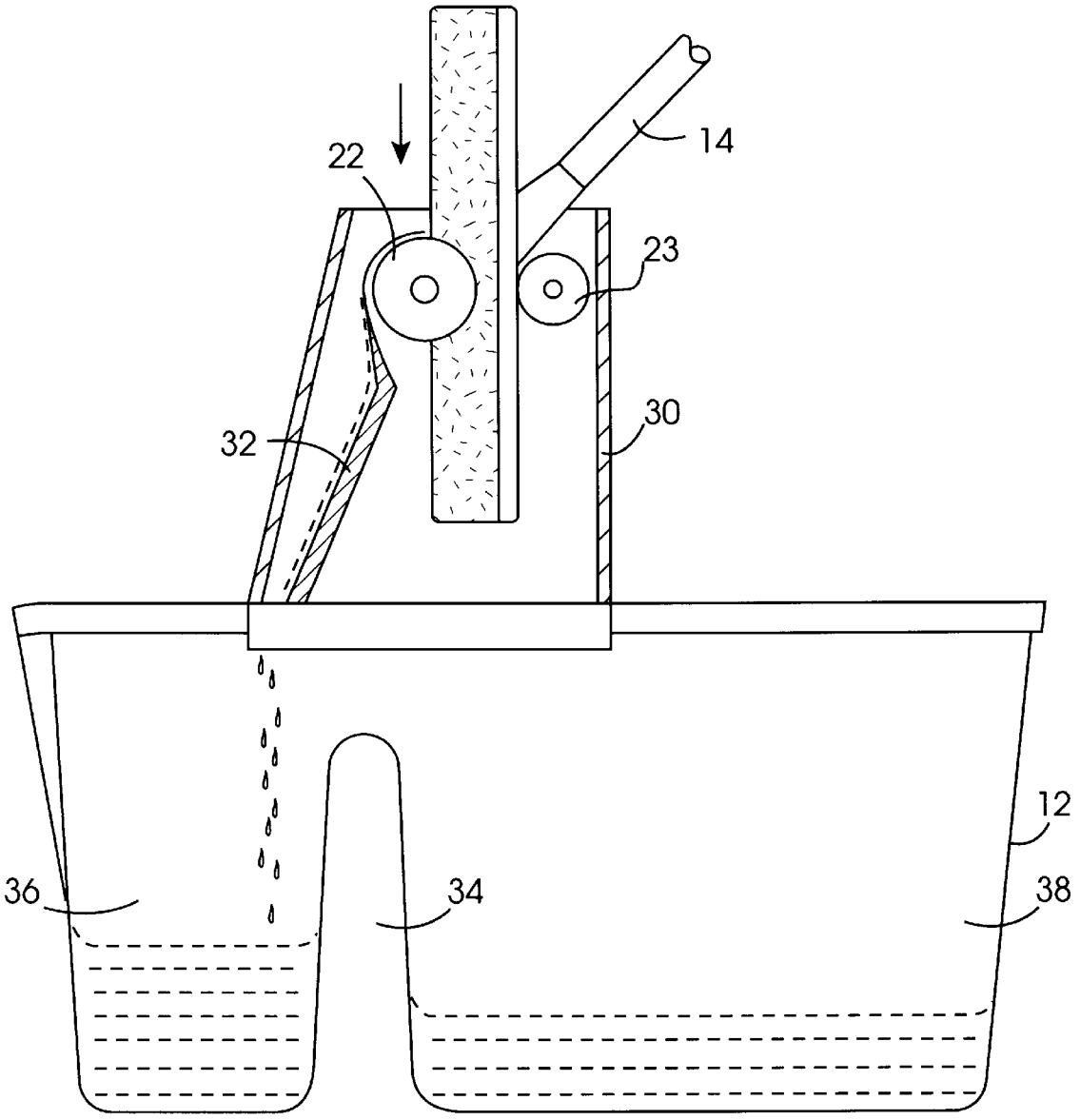
FIG. 6 is a side view of the second embodiment mounted on an alternative bucket.

FIG. 6 shows the apparatus of FIG. 5 in use with a bucket 12 having an internal division 34 which divides the bucket into two compartments 36 and 38. The expelled liquid is directed by the member 32 into the compartment 36, while the compartment 38 can contain clean water for rinsing the mop.

Figure 7:
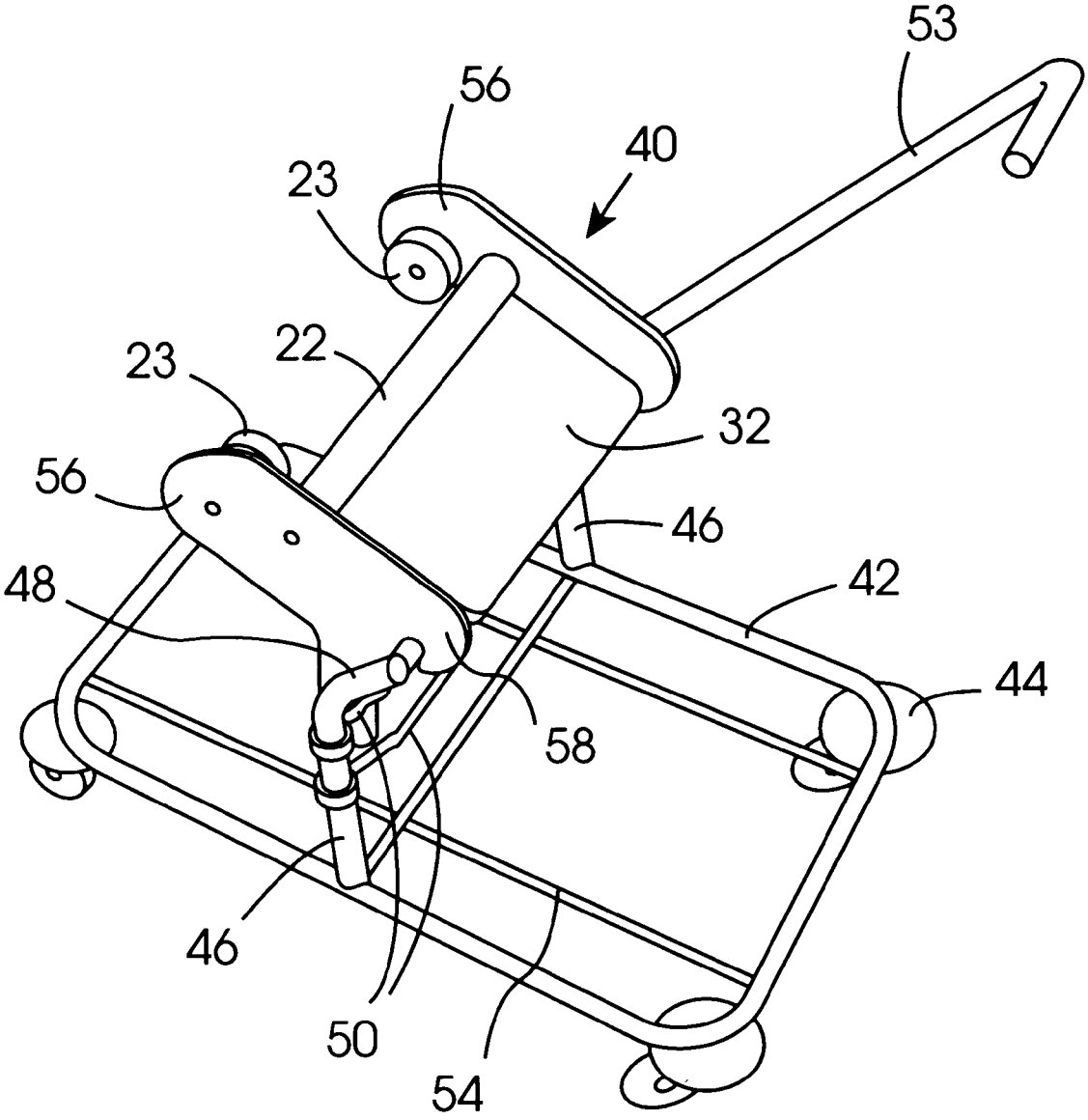
FIG. 7 is a perspective view of a third embodiment of the invention mounted on a trolley.
Figure 8:
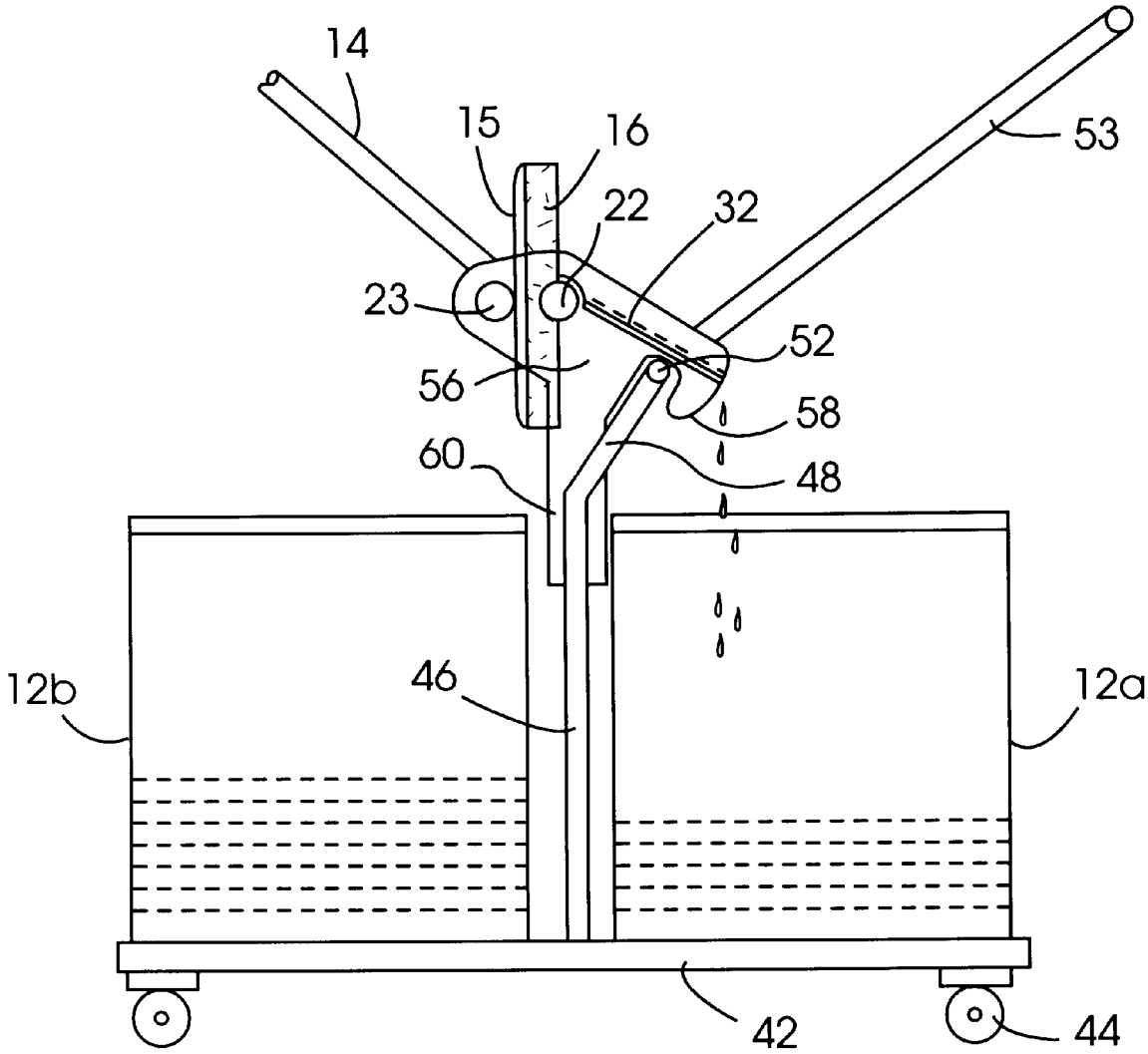
FIG. 8 is a side view of the third embodiment with a pair of buckets mounted on the trolley.

A third embodiment of the invention is shown in FIGS. 7 and 8. In this case a frame 40 carrying the roller 22 and pressure wheels 23 is mounted on a trolley. The trolley comprises a subsantially rectangular base frame 42 with castors 44 at each corner. A pair of upstanding posts 46 are fixed rigidly to the base frame 42 and have upper portions 48 which are bent out of the vertical. A pair of cross members 50 extend between the posts 46 below the bent over portions 48, and a further cross member 52 extends between the top ends of the portions 48. The base frame 42 has a wire grid 54 for supporting two buckets 12*a* and 12*b*, FIG. 8, one on each side of the posts 46. The trolley also has a handle 53 arched to or forming an extension of the bent over portion 48 of one of the posts 46.

The frame 40 is removable mounted on the cross members 50, 52 of the trolley. The frame 40 comprises two parallel side plates 56, the roller 22 extending between the side plates 56 and the pressure wheels 23 being mounted one on the inside of each side plate 56. The orientation and relative positions of the roller 22 and pressure wheels 23 is as described for the previous embodiments. Each side plate 56 is formed with a clip or hook 58 for engaging over the cross member 52, and the frame 40 is stabilised against rotation about the cross member 52 (the centre of gravity of the frame 40 and associated components is to the left of the posts 46 as seen in FIG. 8) by proving the side plates 56 each with a dependent leg 60 which bears against the cross members 50.

Water expelled from the sponge-like material 16 of the mop head passes over the roller 22 and travels down the surface of a sheet member 32 which directs the liquid away from the material 16 and into the bucket 12*a*. The bucket 12*b* can contain clean water for rinsing the mop.

Unlike other known apparatus for removing water from floor mops, the embodiments of the present invention are designed for substantially vertical movement of the mop head when expelling water from the sponge-like material 16. The apparatus does not therefore cause the bucket 12, even when mounted on coasters, to turn over or move around the floor during liquid expulsion which would tend to occur if there were a significant component of horizontal movement of the mop head during liquid expulsion. The embodiments are thus particularly applicable to domestic use where the use of a small bucket or pail is considered essential.

Of course, it is not mandatory that the mop head be pushed vertically through the roller 22 and pressure wheels 23. If the user requires, the mop can be pushed through the apparatus at an angle from the vertical, as seen in dashed lines in FIG. 4 (the vertical direction is shown horizontal in FIG. 4). This is done by raising the handle 14 while pushing down the head of the mop. This maximises the pressure on the sponge-like material 16 when passing through the rollers and wheels so that the user can expel more water from the sponge to assist in better drying of the floor. Of course, the bucket may need to be held stable during such operation.

The embodiment of the invention further eliminate the need to use a pressure lever arm or slide mechanism on the handle of the mop to expel water, and requires less physical effort by the user to expel water compared to those conventional mechanisms. This is because pressure is only required across a relatively small area of the sponge at a time as the mop is pushed through the apparatus. This contrasts with conventional mops required hand leverage, which are limited in size because of the pressure required to squeeze against sponge resistance. Thus, a mop for use with the invention can have a flat head with double or treble the sponge area. This allows the mop to take up double or treble the amount of liquid without additional effort on the part of the user.

The invention is not limited to the embodiments described herein which may be modified or varied without departing from the scope of the invention.

What we claim is:

1. An apparatus for removing liquid from a mop wherein the mop has a mop head comprising a substantially flat plate having a layer of absorbent sponge-like material on one surface, the apparatus comprising a frame carrying a first elongated element and a plurality of second elements the first element being oriented in a direction transverse to the vertical and the second elements being forwardly spaced from the first element by a distance less than the total thickness of the flat plate and sponge-like material wherein, in use, the mop head is urged downwardly between the first and second elements and wherein the second elements bear against the surface of the flat plate opposite the sponge-like material so as to urge the sponge-like material against the first element thereby progessively expelling liquid from the sponge-like material as the sponge-like material moves over the first element.

2. An apparatus as claimed in claim 1 wherein the mop head is capable of being urged downwardly substantially in its own plane.

3. An apparatus as claimed in claim 2 wherein the first element has a rounded surface facing the second element.

4. An apparatus in accordance with claim 2 wherein two second elements are provided, each for bearing against a respective edge of the flat plate on the opposite surface of the sponge-like material.

5. An apparatus as claimed in claim 2 wherein the frame is formed in one piece with, or is adapted to be mounted over, a bucket.

6. An apparatus as claimed in claim 1, wherein the first element has a rounded surface facing the second element.

7. An apparatus in accordance with claim 6 wherein two second elements are provided, each for bearing against a respective edge of the flat plate on the opposite surface of the sponge-like material.

8. An apparatus as claimed in claim 6 wherein the frame is formed in one piece with, or is adapted to be mounted over, a bucket.

9. An apparatus as claimed in claim 6, wherein the first element is a roller.

10. An apparatus in accordance with claim 9 wherein two second elements are provided, each for bearing against a respective edge of the flat plate on the opposite surface of the sponge-like material.

11. An apparatus as claimed in claim 9 wherein the frame is formed in one piece with, or is adapted to be mounted over, a bucket.

12. An apparatus as claimed in claim 1, wherein two second elements are provided each for bearing against a respective edge of the flat plate on the opposite surface to the sponge-like material.

13. An apparatus as claimed in claim 12 wherein the frame is formed in one piece with, or is adapted to be mounted over, a bucket.

14. An apparatus as claimed in claim 12, wherein the second elements are wheels.

15. An apparatus as claimed in claim 14 wherein the frame is formed in one piece with, or is adapted to be mounted over, a bucket.

16. An apparatus as claimed in claim 1, wherein the frame is formed in one piece with, or is adapted to be mounted over, a bucket.

17. An apparatus as claimed in claim 16, wherein the frame is for with clips for removably mounted the frame on the edge of a bucket.

18. An apparatus as claimed in claim 16, wherein the frame is adapted for mounting on a trolley for supporting a bucket.

19. An apparatus as claimed in any one of claims 16, wherein the expelled fluid passes over the top of the first element and the apparatus further includes means for directing fluid expelled from the mop away from the sponge-like material and into the bucket.

20. A cleaning equipment device comprising a mop having a mop head, said mop head comprising a substantially flat plate having a layer of absorbent sponge-like material on one surface, the apparatus comprising a frame carrying a first elongated element and a plurality of second elements the first element being oriented in a direction transverse to the vertical and the second elements being forwardly spaced from the first element by a distance less than the total thickness of the flat plate and sponge-like material wherein, in use, the mop head is urged downwardly between the first and second elements and wherein the second elements bear against the surface of the flat plate opposite the sponge-like material so as to urge the sponge-like material against the first element thereby progessively expelling liquid from the sponge-like material as the sponge-like material moves over the first element.

* * * * *